US006168467B1

(12) United States Patent
Chiou

(10) Patent No.: US 6,168,467 B1
(45) Date of Patent: Jan. 2, 2001

(54) RECEPTACLE CONNECTOR

(75) Inventor: Song-Rong Chiou, Lin-Kou (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/322,363

(22) Filed: May 28, 1999

(30) Foreign Application Priority Data

Aug. 5, 1998 (TW) ..... 87212767

(51) Int. Cl.[7] ..... H01R 13/648
(52) U.S. Cl. ..... 439/607; 439/609
(58) Field of Search ..... 439/607, 609, 439/610, 637

(56) References Cited

U.S. PATENT DOCUMENTS 5,024,609 * 6/1991 Piounneck ..... 439/637
5,637,015 * 6/1997 Tan et al. ..... 439/607
5,718,605 * 2/1998 Morikawa et al. ..... 439/607
5,725,386 * 3/1998 Davis et al. ..... 439/607
6,012,948 * 1/2000 Wu ..... 439/607
6,039,606 * 3/2000 Chiou ..... 439/607

* cited by examiner

*Primary Examiner*—T. C. Patel
(74) *Attorney, Agent, or Firm*—Wei Te Chung

(57) ABSTRACT

A receptacle connector includes an insulative housing defining a receptacle chamber adapted for receivably engaging a mating connector. A plurality of pins is retained in the chamber by means of a spacer. A front shielding shell has a connector engaging section for engaging the mating connector and two side plates extending from the connector engaging section to be fixed to two side faces of the housing thereby securing the front shell to the housing. A rear shielding shell has a U-shaped configuration for covering and being secured to the housing, and for electrically engaging the front shell. The rear shell has a cantilevered arm having a resilient curved section with a convex portion partially received in the receptacle chamber for electrically engaging a grounding member of the mating connector. The curved section has a free end supported on a top face of the housing for providing a more durable structure.

13 Claims, 6 Drawing Sheets

RECEPTACLE CONNECTOR

BACKGROUND OF THE INVENTION

1. Field of the Invention

The present invention generally relates to a receptacle connector for high frequency signal transmission, and in particular to a receptacle connector having a secure EMI shield and which can durably withstand frequent connection/disconnection with a mating connector.

2. The Prior Art

Electrical connectors for high frequency signal transmission are normally provided with shielding means, usually made of metallic material, in order to alleviate or eliminate problems arising from EMI. Examples of EMI shielding designs are disclosed in US Design No. 345,343 and Taiwan patent application Nos. 81110335, 81217896 and 81302112. Conventionally, a shielding member is stamped from a metal sheet, which usually produces a large amount of metal waste in mass production.

Hence, it is desirable to have a receptacle connector having a two piece shielding device which overcomes the problem of excess metal waste encountered in the prior art, while maintaining excellent shielding properties and having a durable structure for ensuring a long service life.

SUMMARY OF THE INVENTION

Accordingly, an object of the present invention is to provide a receptacle connector having a shielding device comprising two separate members electrically engaged with each other for reducing the amount of metal waste generated during a manufacturing process thereof.

Another object of the present invention is to provide a receptacle connector having excellent electromagnetic interference shielding properties.

A further object of the present invention is to provide a receptacle connector having a shielding member with an extended service life.

Still another object of the present invention is to provide a receptacle connector having a durable shielding member which can withstand frequent engagement/disengagement between the receptacle connector and a mating plug connector.

To achieve the above objects, a receptacle connector in accordance with the present invention comprises an insulative housing defining a receptacle chamber adapted for receivably engaging a mating connector. A plurality of pins are retained in the chamber by means of a spacer. A front shielding shell has a connector engaging section for engaging the mating connector and two side plates extending from the connector engaging section to be fixed to two side faces of the housing thereby securing the front shell to the housing. A rear shielding shell has a U-shaped configuration for covering and being secured to the housing and for electrically engaging the front shell. The rear shell has a cantilevered arm having a resilient curved section with a convex portion partially received in the receptacle chamber for electrically engaging a grounding member of the mating connector. The curved section has a free end supported on a top face of the housing for providing a more durable structure.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENTS

Figure 1:
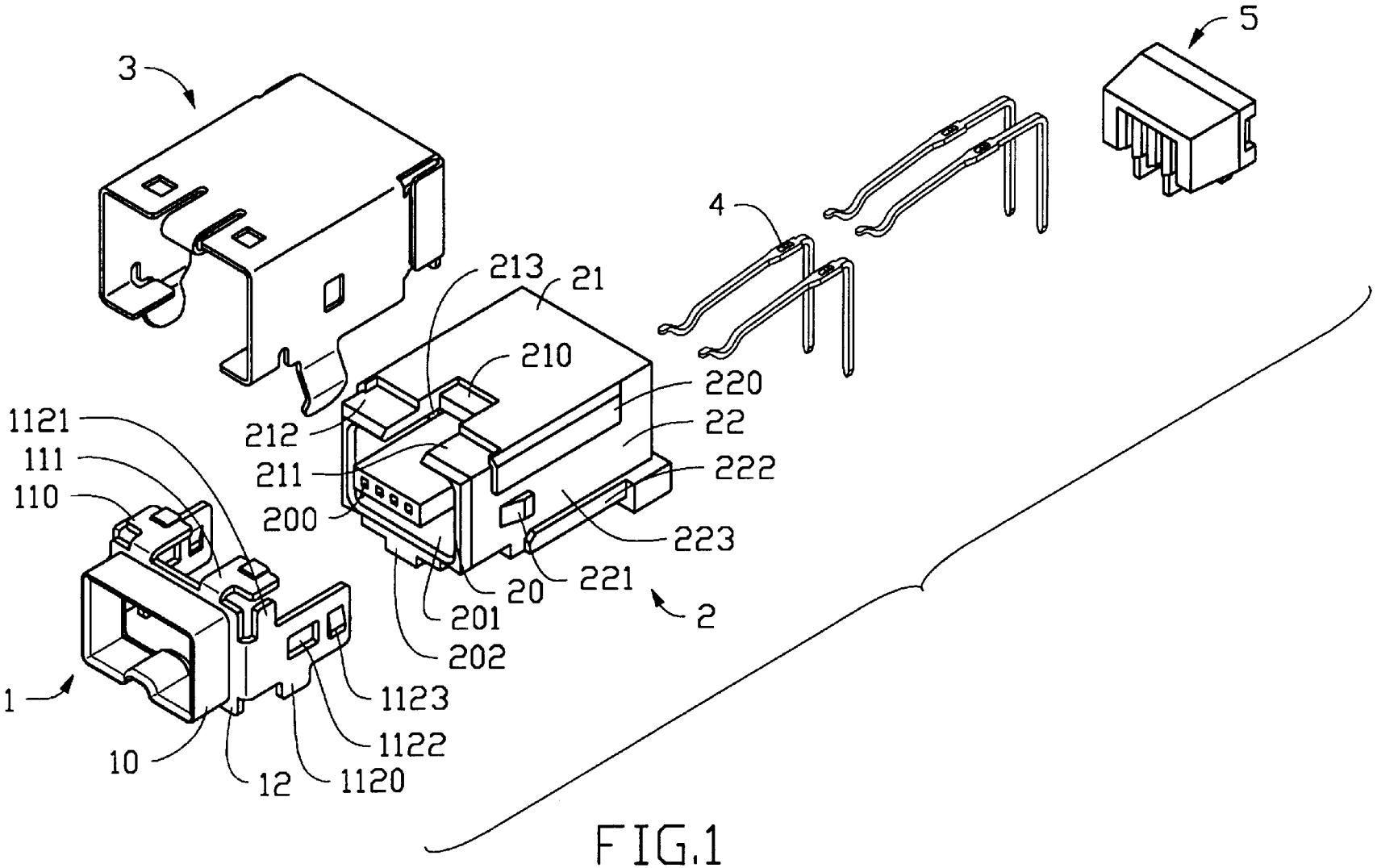
FIG. 1 is an exploded view of a receptacle connector constructed in accordance with the present invention.
Figure 2:
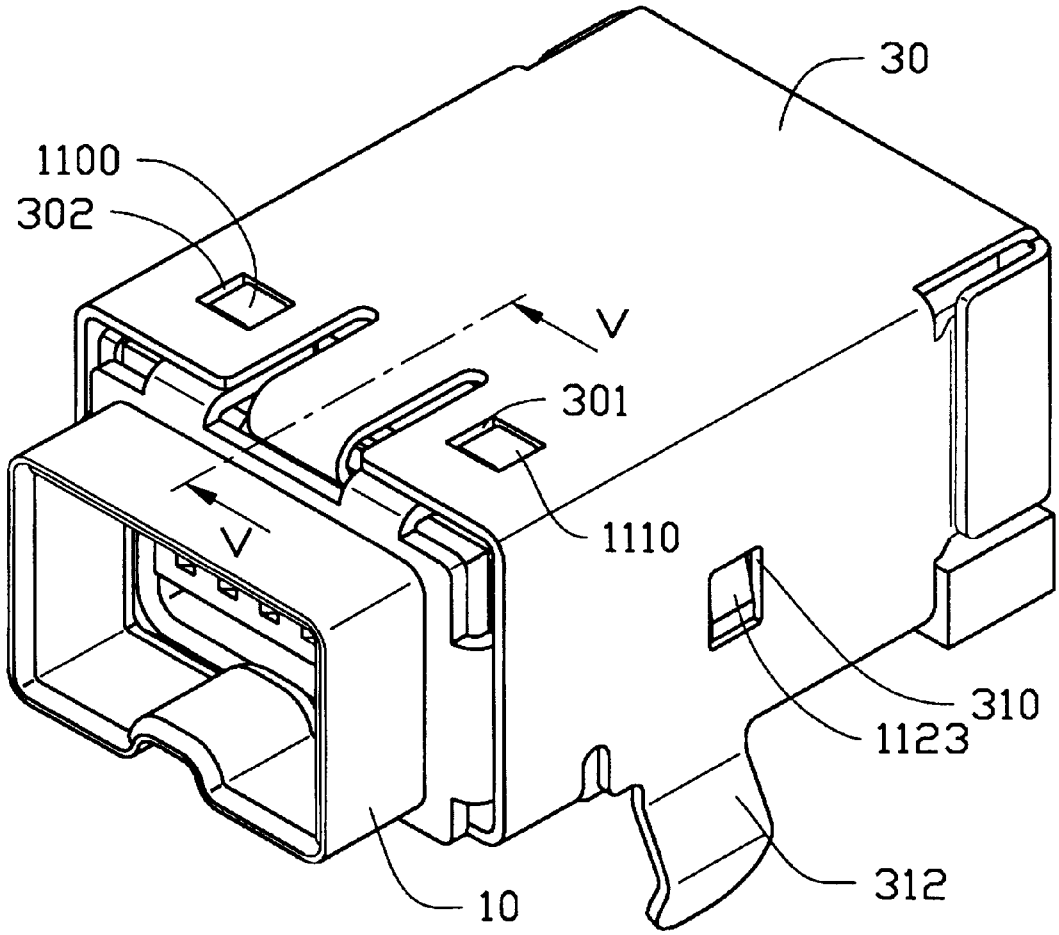
FIG. 2 is an assembled view of FIG. 1.

With reference to the drawings and in particular to FIGS. 1 and 2, wherein a receptacle connector constructed in accordance with the present invention is shown, the receptacle connector comprises an insulative housing 2 having a front face 20 with a receptacle chamber 201 formed therein and adapted to receive a mating connector (not shown). A plurality of pin receiving channels 200 is defined in the receptacle chamber 201 for receiving and retaining conductive pins 4 therein. A spacer 5 for maintaining the proper position of the conductive pins 4 is attached to a rear face of the housing 2.

Figure 3:
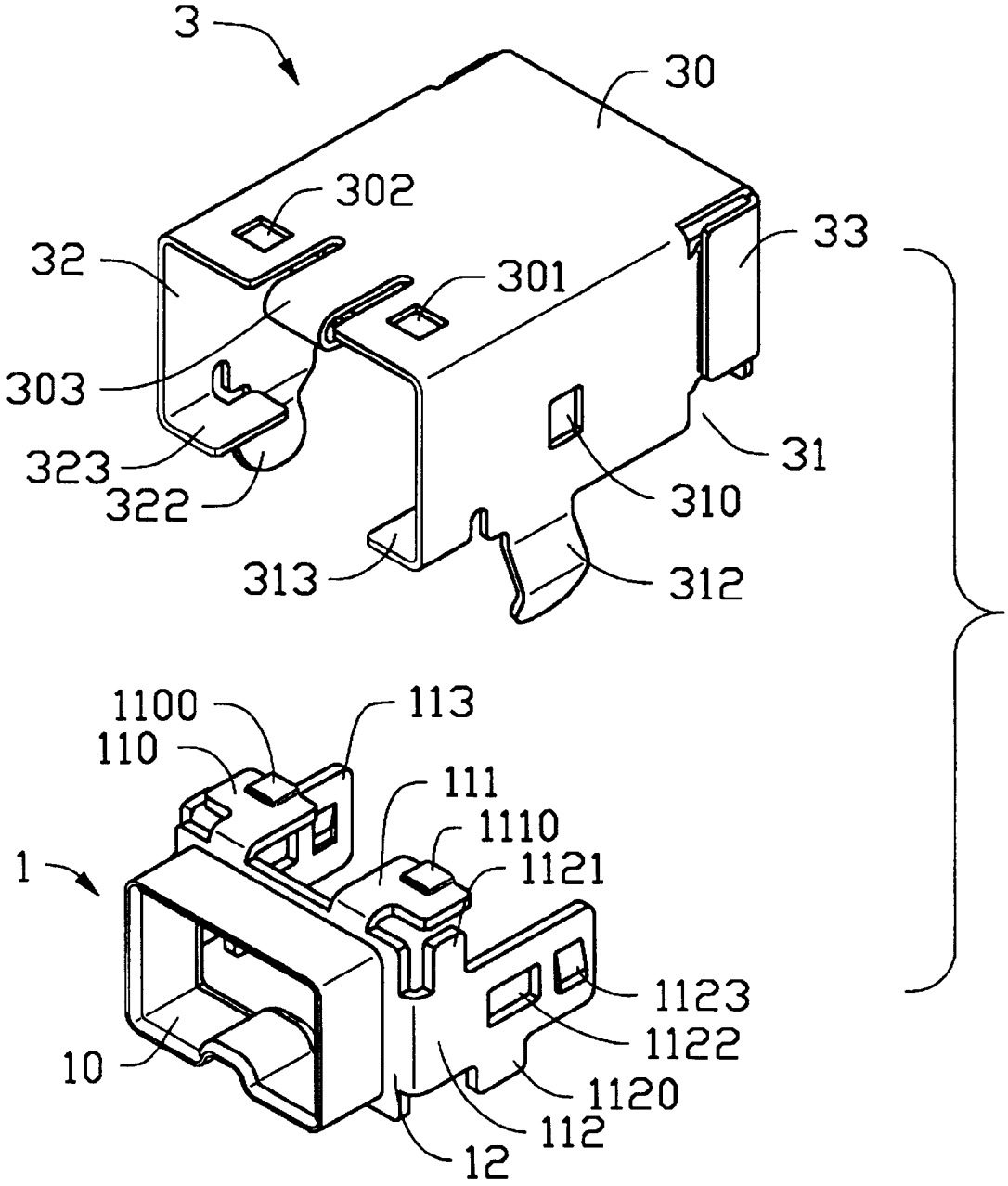
FIG. 3 is a perspective view of a front shell and a rear shell of the receptacle connector of the present invention.
Figure 4:
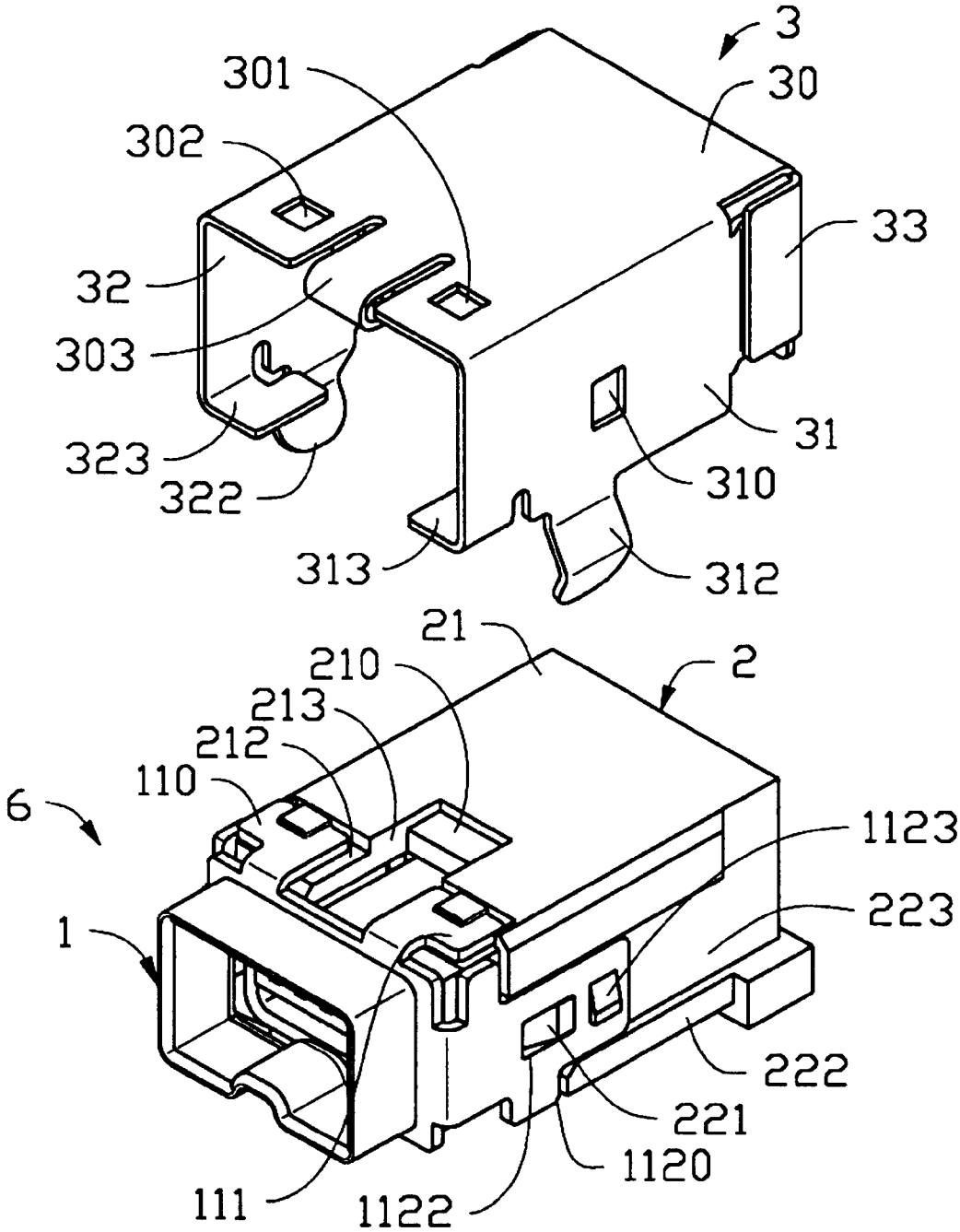
FIG. 4 is a perspective view of the receptacle connector with the rear shell detached therefrom.

Also referring to FIGS. 3 and 4, a front shielding shell 1, made of conductive material, such as metal, is shaped to fit over a front portion of the housing 2. The front shell 1 comprises a connector engaging section 10 having a configuration adapted to receive the mating connector therein and two side plates 112, 113 extending from opposite sides of the connector engaging section 10 and sufficiently spaced from each other to accommodate the front portion of the housing 2 therebetween. A shoulder 12 is formed between the connector engaging section 10 and the side plates 112, 113 so that when the front portion of the housing 2 is fit into the front shell 1, the front face 20 of the housing 2 is in contact with the shoulder 12 of the front shell 1.

The side plate 112 forms two lugs 1120, 1121 transversely extending therefrom in opposite directions. The side plate 112 also defines an opening 1122 therein. The side plate 113 has the same configuration as the side plate 112.

The housing 2 has two opposite side faces 22 for slidably engaging with the two side plates 112, 113, respectively. Each of the side faces 22 forms two projections 220, 222 thereon corresponding to the lugs 1120, 1121 of the front shell 1. When assembling the front shell 1 to the front portion of the housing 1, the lugs 1120, 1121 contact the projections 220, 222 and thus the projections 220, 222 prevent further movement of the front shell 1 with respect to the housing 2. The two projections 220, 222 define a passage 223 therebetween for receiving the corresponding side plate 112, 113 of the front shell 1. A barb 221 is provided within each passage 223 for engaging with the opening 1122 of the corresponding side plate 112, 113 for retaining the front shell 1 in position with respect to the housing 2.

The front shell 1 further comprises two upper extensions 110, 111 for being slidably received in two corresponding recesses 211, 212 defined in a top face 21 of the housing 2. Each of the upper extensions 110, 111 has a raised portion 1100, 1110. The recesses 211, 212 have a depth substantially equal to a thickness of the upper extensions 110, 111 of the front shell 1 whereby the raised portions 1100, 1110 of the upper extensions 110, 111 project beyond the top face 21 of the housing 2. A sub-assembly 6 is thus formed by attaching the front shell 1 to the housing 2.

A rear shielding shell 3 made of conductive material, such as metal, to serve as grounding means, has a top wall 30 and two side walls 31, 32 extending from opposite edges thereof. The rear shell has a U-shaped configuration for being fit over the sub-assembly 6 whereby the two side walls 31, 32 cover the side faces 22 of the housing 2 and the side plates 112, 113 of the front shell 1. The projections 220, 222 of the side faces 22 have a thickness substantially equal to a thickness of one of the side plates 112, 113 of the front shell 1 thereby forming a substantially continuous flat surface for smoothly abutting against the corresponding side wall 31, 32 of the rear shell 3.

Each of the side walls 31, 32 of the rear shell 3 is provided with an opening 310 for engaging a projection 1123 formed on the corresponding side plate 112, 113 of the front shell 2. Thus, the rear shell 3 is retained on the sub-assembly 6. The rear shell 3 also has a rear wall 33 extending from a rear edge for retaining the spacer 5 in the housing 2.

The rear shell 3 is fit over the top face 21 of the housing 2 and the two raised portions 1100, 1110 of the upper extensions 110, 111 of the front shell 1 project through corresponding openings 301, 302 defined in the top wall 30 of the rear shell 3. A lug 313, 323 inwardly extends from a bottom edge of each side wall 31, 32 of the rear shell 3 for engaging a bottom face (not labeled) of the housing 2 thereby securely fixing the rear shell 3 to the housing 2. The rear shell 3 also comprises extensions 312, 322 downwardly protruding from the side walls 31, 32. The extensions 312, 322 serve as positioning means for positioning the receptacle connector on a circuit board (not shown).

The contact engagement between the openings 301, 302 of the rear shell 3 and the raised portions 1100, 1110 of the front shell 1 provides electrical engagement between the rear shell 3 and front shell 2. Furthermore, the contact engagement between the openings 310 of the rear shell 3 and the barbs 1123 of the front shell 1 provides additional electrical engagement between the rear shell 3 and the front shell 1.

A latch 303 is formed on a front edge of the rear shell 3 as a cantilevered arm having a free end bent back to form a U-shaped configuration. To accommodate the latch 303, a cutout 213 is defined in the top face 21 of the housing 2 with a step 210 formed inside the cutout 213. In the embodiment illustrated, the cutout 213 is located between the two recesses 211, 212 and is in communication with the receptacle chamber 201 of the housing 2.

Figure 5:
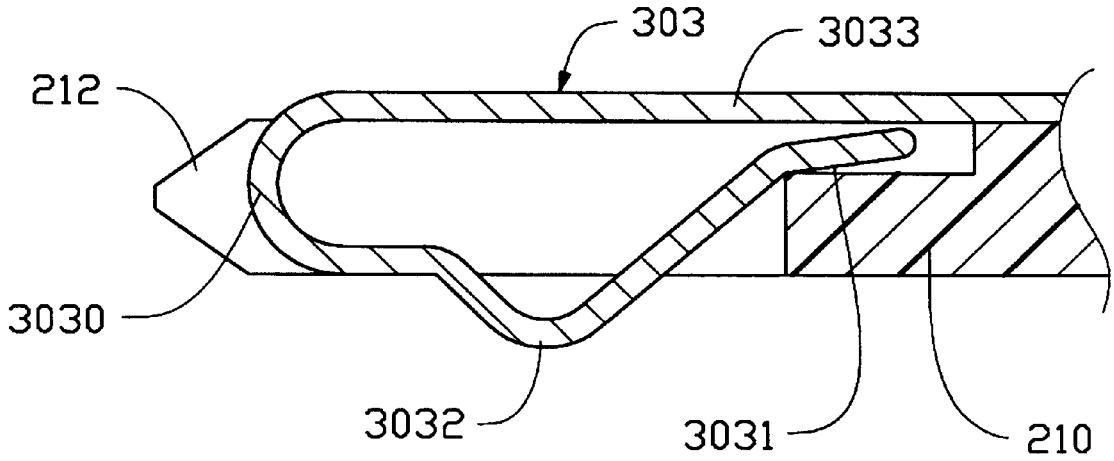
FIG. 5 is a cross-sectional view taken along line V—V of FIG. 2.
Figure 6:
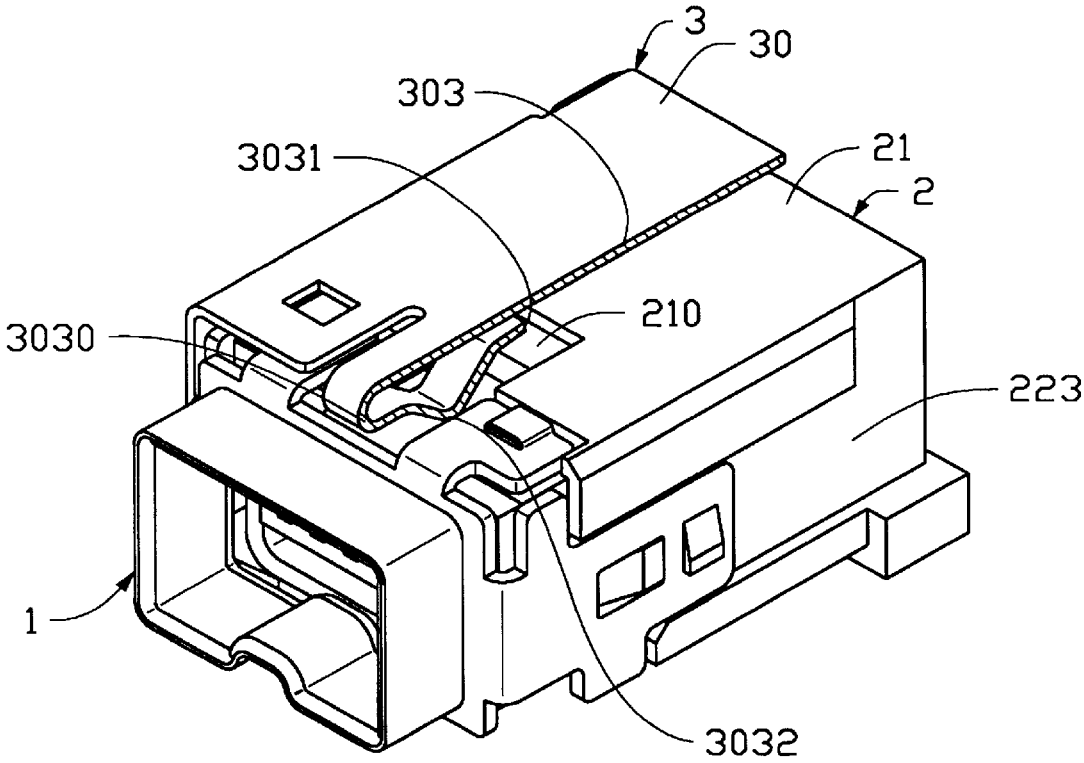
FIG. 6 is a partial cutaway view of FIG. 2.

As shown in FIGS. 5 and 6, the latch 303 comprises a straight section 3033 extending from the rear shell 3, a U-shaped connecting section 3030 extending from the straight section 3033,and a resilient curved section 3032 extending from the connecting section 3030 and spaced from the straight section 3033. The curved section 3032 extends into the cutout 213 of the top face 21 of the housing 2. The curved section 3032 comprises a convex portion (not labeled) partially extending into the receptacle chamber 201 so that when the mating connector is inserted into the receptacle chamber 201, a grounding member of the mating connector, usually in the form of a plate, contacts the convex portion thereby establishing electrical connection therebetween. The convex portion of the curved section 3032 exerts a biasing force on the grounding member thereby providing a firm electrical engagement between the latch 303 of the rear shell 3 and the grounding member of the mating connector. The step 210 of the housing 2 supports a free end 3031 of the curved section 3032 of the latch 303. Preferably, the free end 3031 of the curved section 3032 is bent to be snugly supported on the step 210. The provision of the step 210 allows the free end 3031 of the curved section 3032 to be securely retained between the step 210 and the straight section 3033. Thus, deformation of the curved section 3032 during withdrawal of the mating connector out of the receptacle chamber 201 is prevented.

Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. A receptacle connector comprising:

an insulative housing having a front face with a receptacle chamber formed therein and adapted to receive a mating connector, the housing having securing means comprising two spaced projections and a barb formed on each of opposite side faces of the housing;

a front shielding shell having a connector engaging section adapted to receive the mating connector therein and two spaced side plates extending from opposite sides of the connector engaging section for receiving a front portion of the housing therein with the side plates covering the side faces of the housing and secured thereto, each side plate being received between the spaced projections of the securing means of the housing, and defining an opening receiving the barb of the housing; and a rear shielding shell having a U-shaped configuration formed by a top wall and two side walls extending from the top wall for covering the side faces of the housing and the side plates of the front shell, the rear shell being fixed to the housing by engaging means, the rear shell comprising connection means formed thereon for electrically engaging with a grounding member of the mating connector.

2. The receptacle connector as claimed in claim 1, wherein the connection means of the rear shell comprises a straight section extending from the rear shell, a U-shaped connecting section extending from the straight section, and a resilient curved section extending from the connecting section and spaced from the straight section, the curved section having a convex portion partially extending into the receptacle chamber for contacting the grounding member of the mating connector.

3. The receptacle connector as claimed in claim 2, wherein the housing defines a cutout in a top face thereof in communication with the receptacle chamber, and wherein the curved section of the connection means is located within the cutout and the convex portion thereof is partially located in the receptacle chamber.

4. The receptacle connector as claimed in claim 3, wherein the cutout has a step formed therein and wherein the curved section of the connection means has a free end supported on the step.

5. The receptacle connector as claimed in claim 1, wherein each side plate of the front shell comprises at least one lug engageable with one of the projections on the corresponding side face of the housing to retain the front shell in position with respect to the housing.

6. The receptacle connector as claimed in claim 5, wherein each side plate of the front shell has two lugs extending in opposite directions for respectively engaging the projections on the corresponding side face of the housing.

7. The receptacle connector as claimed in claim 1, wherein the front shell comprises a shoulder formed between the connector engaging section and the side plates, the shoulder being engaged by the front face of the housing thereby positioning the front shell with respect to the housing.

8. The receptacle connector as claimed in claim 1, wherein the engaging means for fixing the rear shell to the housing comprises an opening defined in each side wall of the rear shell and a barb formed on the corresponding side plate of the front shell for engaging with the opening.

9. The receptacle connector as claimed in claim 7, wherein a top face of the housing defines at least one recess for receiving a corresponding upper extension of the front shell, a projection being formed on each upper extension for engaging with an opening defined in the top wall of the rear shell thereby fixing the rear shell to the housing.

10. The receptacle connector as claimed in claim 1, wherein the engaging means for fixing the rear shell to the housing comprises a tab inwardly extending from each side wall of the rear shell for engaging a bottom face of the housing.

11. The receptacle connector as claimed in claim 1, wherein the connector further comprises a plurality of pins received in the receptacle chamber of the housing, the pins being retained in position by means of a spacer fixed in the housing by a rear wall of the rear shell.

12. A connector comprising:

an insulative housing having a front face with a receptacle chamber therein and adapted to receive a mating connector;

a front shielding shell attached to the housing and having a connector engaging section adapted to receive the mating connector; and a rear shielding shell fastened to the front shielding shell and having at least a top wall with a reversely bent connection means thereon for electrically engaging with a grounding member of the mating connector; wherein said housing defines a cutout in a top face with a step aside so that the connection means extend through said cutout into the chamber with a free end thereof resting upon said step.

13. A receptacle connector comprising:

an insulative housing having a front face with a receptacle chamber formed therein and adapted to receive a mating connector, and a top face defining a recess therein, the housing having securing means formed on opposite side faces thereof;

a front shielding shell having a connector engaging section adapted to receive the mating connector therein and two spaced side plates extending from opposite sides of the connector engaging section for receiving a front portion of the housing therein with the side plates covering the side faces of the housing and secured thereto by the securing means of the housing, the front shell comprising an upper extension received in the recess of the housing and a shoulder formed between the connector engaging section and the side plates and engaging with the front face of the housing thereby positioning the front shielding shell with respect to the insulative housing, the upper extension forming a projection thereon; and a rear shielding shell having a U-shaped configuration formed by a top wall defining an opening engaging with the projection of the upper extension of the front shielding shell thereby fixing the rear shielding shell to the insulative housing, and two side walls extending from the top wall for covering the side faces of the housing and the side plates of the front shell, the rear shell comprising connection means formed thereon for electrically engaging with a grounding member of the mating connector.

* * * * *